US007108031B1

(12) United States Patent
Secrest

(10) Patent No.: US 7,108,031 B1
(45) Date of Patent: Sep. 19, 2006

(54) METHOD OF MAKING PATTERNS IN WOOD AND DECORATIVE ARTICLES OF WOOD MADE FROM SAID METHOD

(76) Inventor: David Secrest, P.O. Box 399, 215 Cramer Creek Rd., Somers, MT (US) 59932-0399

( * ) Notice: Subject to any disclaimer, the term of this patent is extended or adjusted under 35 U.S.C. 154(b) by 41 days.

(21) Appl. No.: 10/355,765

(22) Filed: Jan. 31, 2003

Related U.S. Application Data

(60) Provisional application No. 60/353,533, filed on Jan. 31, 2002.

(51) Int. Cl.
*B27M 3/00* (2006.01)
*B27C 9/00* (2006.01)

(52) U.S. Cl. ..... 144/358; 144/359; 144/380; 144/1.1; 144/2.1

(58) Field of Classification Search ..... 144/330–332, 144/344–350, 352, 380, 358, 359, 364, 368; 156/39–46, 58, 346–348, 580, 581, 582, 156/583.1; 264/119, 120, 220
See application file for complete search history.

(56) References Cited

U.S. PATENT DOCUMENTS 3,536,574 A * 10/1970 Buckley ..... 428/151
3,621,897 A * 11/1971 Vazzola et al. ..... 144/37
4,231,573 A * 11/1980 Kelly ..... 473/117
4,606,388 A * 8/1986 Favot ..... 144/361
5,971,045 A * 10/1999 Watanabe ..... 144/213
6,344,101 B1 * 2/2002 Graf ..... 156/220
6,395,204 B1 * 5/2002 Neogi et al. ..... 264/37.1

FOREIGN PATENT DOCUMENTS

JP 405076827 * 3/1993

* cited by examiner

*Primary Examiner*—Derris H. Banks
*Assistant Examiner*—Shelley Self
(74) *Attorney, Agent, or Firm*—Robert B. Hughes; Hughes Law Firm, PLLC

(57) ABSTRACT

A method for providing a decorative wood surface that is two-dimensional but creates a three-dimensional visual pattern. The upper surface of a wood member is embossed to form ridges, valleys, and transition zones. After embossing, the upper portions of the ridges are removed so as to leave a substantial planar surface which is made up of lower portions of the ridges, upper portions of the valleys, and slanted surface portions of the transition areas. The result is that there are different reflective patterns which provide the three-dimensional visual effect.

16 Claims, 4 Drawing Sheets

METHOD OF MAKING PATTERNS IN WOOD AND DECORATIVE ARTICLES OF WOOD MADE FROM SAID METHOD

RELATED APPLICATIONS

This application claims priority benefit of U.S. Ser. No. 60/353,533, filed Jan. 31, 2002.

BACKGROUND OF THE INVENTION a) Field of the Invention

The present invention relates, generally, to woodworking. More particularly, the invention relates to the method for making a pattern in wood. The invention has particular utility for decorative wood products.

b) Background Art

Wood with a distinctive surface appearance has long been valued for decorative applications, such as furniture, musical instruments, and art. The surface appearance of wood is a combination of the growth-ring structure or grain, the orientation of the surface that results from cutting, and particular anatomical features of the wood. The term "figure" is used to refer to distinctive markings on longitudinal or side grain surfaces of wood, generally when referring to more decorative woods. For example, there is curly maple, fiddle-back mahogany, ribbon or strip figure, bird's-eye figure, blister figure, and quilted figure. When such wood is finished flat and smooth, a desirable visual effect is produced by variable light reflection intersecting the surface at various angles to the uneven or undulating cell structure in the wood. A thorough discussion of figure in wood can be found in "Understanding Wood" by Bruce Hoadley (published in 2000 by Taunton Press, ISBN 1-561158-358-8).

The state of the art includes various devices and methods for working the surface wood to create decorative patterns and shapes. Three-dimensional shapes and patterns are conventionally milled into the wood. Composite wood material is pressure-molded to achieve the desired pattern. The surface of such wood is purposefully left three-dimensional to achieve its desired decorative effect.

Also, it is known that in ferrous metals there is a technique called pattern welding "Damascus", or in fine metals, such as gold and silver, it is called "Mokome Game", and a similar technique in glass is referred to as "Cameo Glass". These techniques rely on the layering of opaque contrasting materials, and then exposing these materials in such a way as to create a pleasing line or series on the material surface.

A search of the patent literature has developed several patents, these being the following:

U.S. Pat. No. 619,298 (Gochnaur) shows a "wood grainer" which comprises a tool having a flexible plate constructed of vulcanized rubber, and having on its outer surface a design which is impressed on the surface of the plate or cover under high pressure and temperature to form a pattern simulating the grain of a wood surface. In operation, the device is dragged over the surface that is being treated, and can be tilted at different angles to produce a different configuration.

U.S. Pat. No. 1,441,922 (Gstalder) discloses a "graining tool" which has a rubber surface having a pattern of ridges thereon.

U.S. Pat. No. 3,486,919 (Dreazy et al.) discloses a process of providing a grain pattern of ornamental wood to the surface of a panel, such as plywood or hardboard. The panel is first sanded and then coated with a sealer. The sealer coat is dried and then grooves are formed in the plank and are prime coated with a base pigmented paint. The panel is sanded with a 240E grit belt sander and a pigmented ground coat is applied to mask completely the natural color of the wood. The panel is next embossed to form a substantial portion of the pores that appear in natural wood that is to be simulated, with this being done by an embossing roller. Next, the panel is subjected to a series of painting steps. Then, the panel is subjected to a brush print of the general grain pattern of the planks of wood to be simulated. This provides a shadow background of the detailed ground pattern. After the printing step is completed, the embossed pores are filled with a dark filler material, followed by applying a clear top finish material.

U.S. Pat. No. 3,843,992 (Briggs) shows a wood-graining material having a surface of rubber or flexible plastic with a graining surface thereon. The layer of material is easily and readily snapped onto and off the curved surface of the tool.

U.S. Pat. No. 4,007,767 (Colledge) discloses a "high-speed rotary branding process," for a wood surface. This comprises a die pattern thereon which is rolled over the material at a temperature of about 800° degrees to 900° degrees F. It is stated that operating at this temperature will provide the desired result, and also minimize the deterioration of the die pattern.

U.S. Pat. No. 5,507,064 (King) discloses a wood-graining tool which comprises a flexible panel positioned around a cylinder and a series of embossed ribs. The rib portions desirably extend in angular relationships of generally 40° degrees to 50° degrees relative to the edges of the tool.

SUMMARY OF THE INVENTION

The method of the present invention is able to form a pattern in the surface of a wood member so that there is an exposed substantially two-dimensional surface which gives the visual impression of a three-dimensional surface. This method takes advantage of the inherent reflective qualities of the individual wood cells in order to achieve a figured effect. Also, the wood article produced by the method of the present invention is able to reflect light in various ways so as to produce a three-dimensional visual effect.

In the method of the present invention, there is provided a wood member which has a wood surface and wood cells formed in the wood cell structure of the wood member. The wood member has a plurality of wood cell structure portions at higher and lower levels relative to the wood surface. The surface of the wood member is embossed to form a pattern of ridges and valleys at the wood surface. The resulting wood cell structure comprises ridge wood cell structure portions at higher and lower levels adjacent to the upper wood surface, and valley wood cell structure portions at higher and lower levels adjacent to the wood surface.

Also, there are transition wood cell structure portions which are located between adjacent wood and valley wood cell structure portions, and which are slanted and are higher and lower levels. The valley wood cell structure portions are displaced downwardly relative to the ridge wood cell structure portions. The transition wood cell structure portions are slanting downwardly from the adjacent ridge wood cell structure portions to adjacent valley wood cell structure portions.

After the embossing of the wood member, at least upper portions of the wood cell structure portions and upper portions of the transition wood cell structure portions are removed to form a modified exposed surface comprising exposed wood surface portions which comprise lower level ridge portions of the ridge wood cell structure portions and higher level valley portions of the valley wood cell structure portions. Also, there are the exposed wood surface portions of the transition wood cell structure portions that are located at a lower position in the wood member after embossing.

Thus, the modified exposed surface that is created has a contrasting surface pattern with a three-dimensional visual effect.

In a preferred form of the present invention, prior to embossing the wood member, the wood member is plasticized at at least upper wood cell structure portions to soften lignin therein. This can be accomplished by subjecting the wood member to heat, such as by placing the wood member in a steam chamber. Alternatively, the wood member can be plasticized by use of a chemical agent, and particularly exposing the wood member to anhydrous ammonia, or subjecting the wood member to pressurized ammonia gas.

The embossing can be accomplished by pressing a die against the wood surface. This die is able to be a heated die. Also, a flat die can be used or a roller die.

In the preferred form, the wood member is dried after embossing the wood member.

Also in the preferred form, the removing of at least upper portions of the ridge cell structure portions is accomplished in a manner to form the modified exposed wood surface as a planar surface. The transition wood cell structure portions are positioned at a slant relative to the modified exposed wood surface, and the maximum slant of the transition wood cell structure portions would be greater than zero degrees and not greater than about one-half of a right angle. A more preferred range is between angles of at least 3° degrees and 35° degrees, and in the more preferred range where the angle of slant is between 5° degrees and 15° degrees.

Also, the present invention comprises a decorative article of wood made in accordance with the processing steps of the present invention. Desirably, after the removal of the upper ridge cell structure portions to form a substantially flat surface, the surface is finished with a lacquer or protective coating which is permeable to light so as to provide reflections from the wood surface.

The article of wood made from the present invention is the result of performing the embossing of the wood member and also the removal of at least the upper portions of the wood cell structure portions. This article of wood is characterized in that the surface portions at ridge zones of the surface comprise lower level ridge portions of the ridge cell structure portions. Further, the surface portions at the valley zones comprise higher level valley portions of the valley wood cell structure portions.

The surface portions at the transition zones comprise portions of the transition wood cell structure portions that are positioned at lower locations in the wood member after embossing. Further, these portions of the transition wood cell structure have wood cell orientations which are aligned differently from wood cell orientations of the surface portions of the ridge zones and the valley zones. Thus, the light is reflected differently from the surface portions of the transition zones, than from the surface portions of the ridge and valley zones.

Other features of the present invention will be apparent from the following detailed description.

DETAILED DESCRIPTION OF THE PREFERRED EMBODIMENTS

Figure 1:
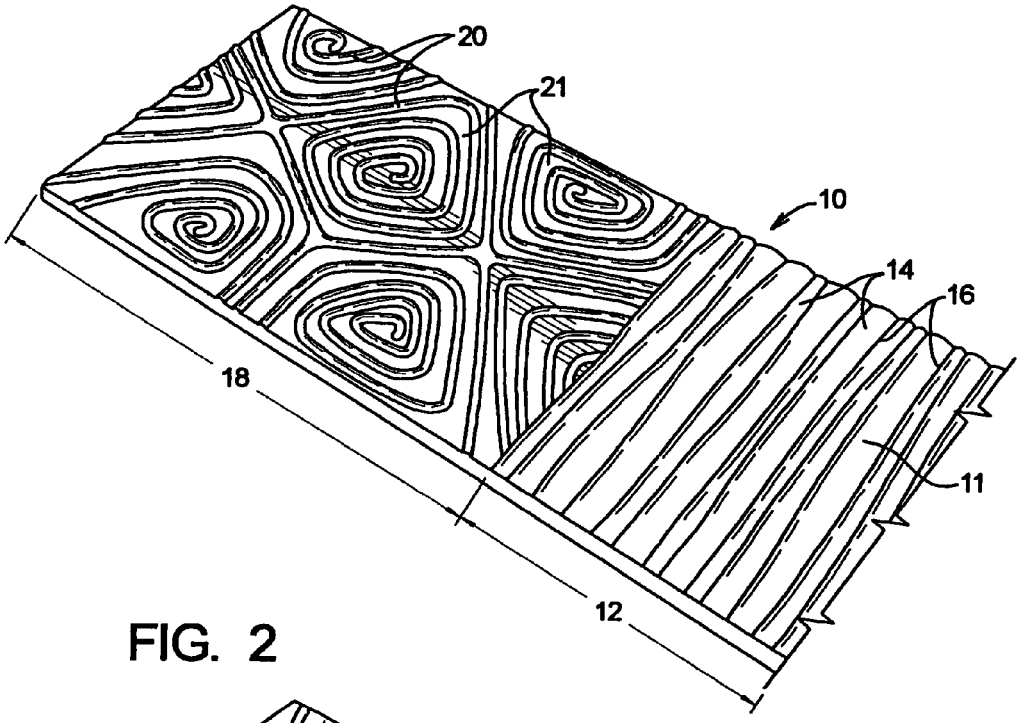
FIG. 1 is a perspective view of a piece of wood embossed with a three-dimensional pattern.
Figure 2:
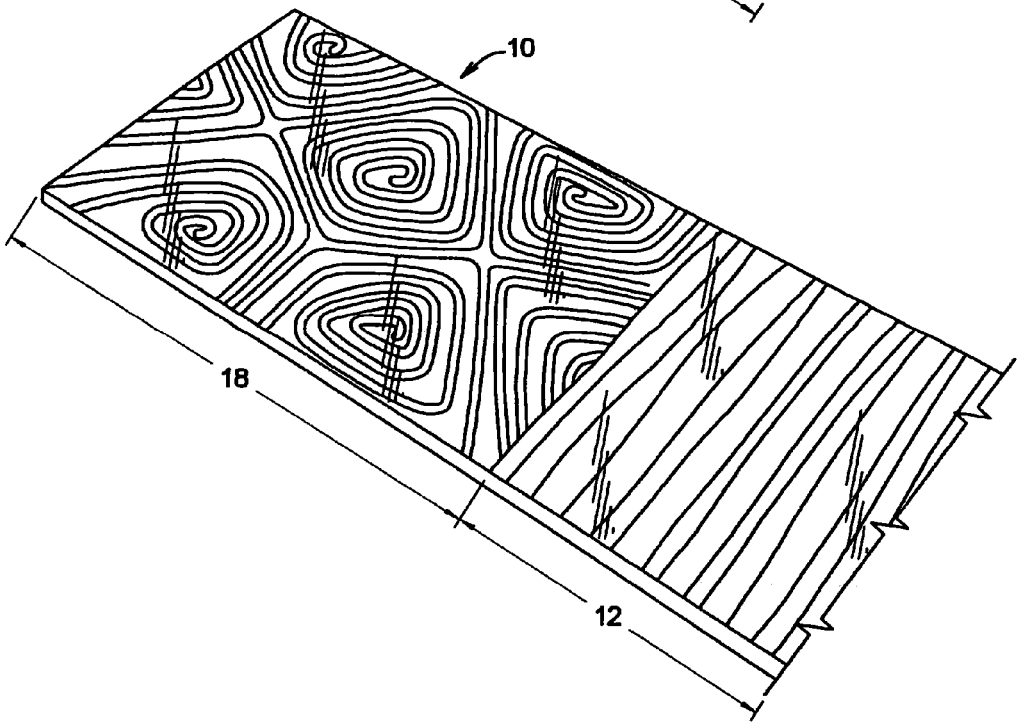
FIG. 2 is the view of FIG. 1 after the wood has been finished smooth by removing the embossments, with the three-dimensional visual pattern from the embossing showing on the two-dimensional smooth surface.

Referring to FIGS. 1–2, the present invention is a process for creating a three-dimensional pattern in wood that shows when the wood is finished smooth. A pattern can be made to simulate wood figure, such as curly, fiddleback, bird's-eye, stripe or other well-known figure patterns, or the pattern may be any desirable pattern such as a decorative design or an imprinted name.

The basic process is to provide a wood member 10 (a portion of which is shown in FIG. 1) and to emboss a pattern into the surface 11 (see FIG. 3) of the wood member 10, then remove the embossments and finish the surface smooth to form a modified surface pattern, as illustrated in FIG. 2. In the example shown, the wood member 10 in FIG. 1 has a first embossed portion 12 with a decorative pattern of ridges 14 and valleys 16, and a second portion 18 embossed with a decorated pattern of ridges 20 and valleys 21. The embossing process changes the orientation of the wood cell structure under the embossed pattern. When the embossments are removed, as illustrated in FIG. 2, the surface of the wood is formed as the modified surface pattern which still displays the variable angled cell pattern in the portions 12 and 18 created by the embossing process. When the surface is sanded smooth and a transparent finish applied, the modified surface pattern (which seems to be three-dimensional) is actually a two-dimensional smooth surface. Since the process produces a change in the wood cell structure, the pattern has depth to it and is not merely on the surface of the wood. Therefore, unlike conventional graining processes, damage to the finished surface can be sanded and repaired without completely removing the pattern created by the process.

This process can simulate desirable figure in wood that normally does not display any such figure. For example, a curly or bird's-eye pattern can be simulated in ordinary maple, or a fiddleback pattern simulated in ordinary mahogany. This process can also produce a figured effect in a variety of wood species that are not normally associated with exhibiting figure of their own, (for example, pine, alder, and poplar).

Figure 3:
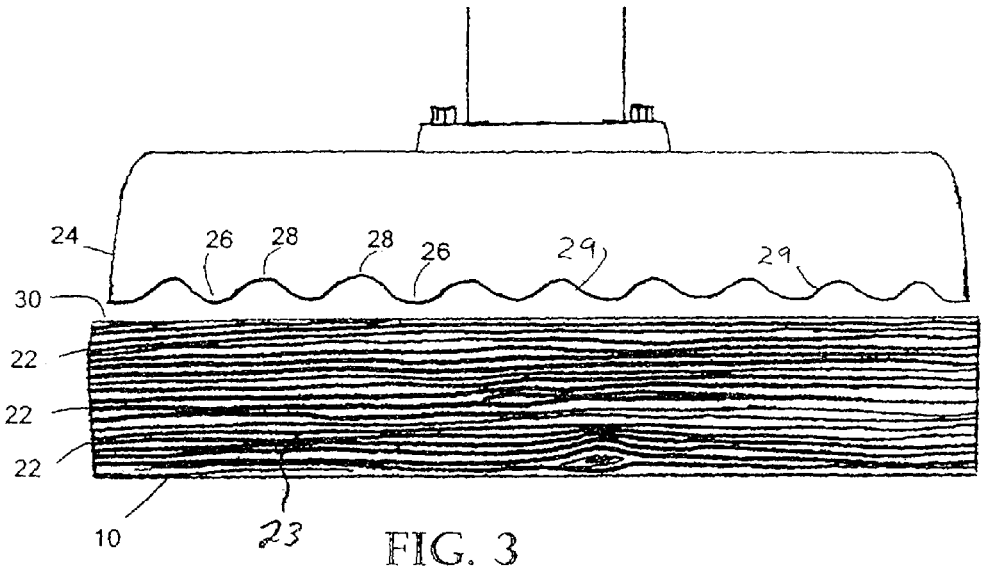
FIG. 3 is an illustration of a side view of a piece of wood and an embossing die before the wood is embossed.

The process and its effect on the cell structure of wood is illustrated in FIGS. 3–8. Referring to FIG. 3, the cell structure of wood portion 10 is illustrated by a plurality of generally horizontal lines 22 to represent a wood cell structure 23. These lines 22 are for illustrative purposes of one embodiment and are not necessarily representative of the cell alignment in the wood portion 10. The cell alignment may be oriented in various directions in the wood cell structure 23 and may in some instances be at various orientations relative to the wood surface 11. In this illustration, the embossing die 24 has a pattern with a plurality of ridges 26 and valleys 28 with sloping transition surfaces 29 extending therebetween. Within the broader scope of the present invention, the terms "ridges" and "valleys" is intended to refer not only to raised and depressed portions that follow along a lengthwise dimension, but are meant to include raised and lowered portions that could have lateral and length dimensions which are equal or closer to being equal with one another, such as circular, square, oval, or rectangular shapes, irregular shapes, or other shapes. Also the ridges and valleys 26 and 28 could have varying widths and lengths. Furthermore, there could be artistic representations, such as abstract designs, etc.

Figure 4:
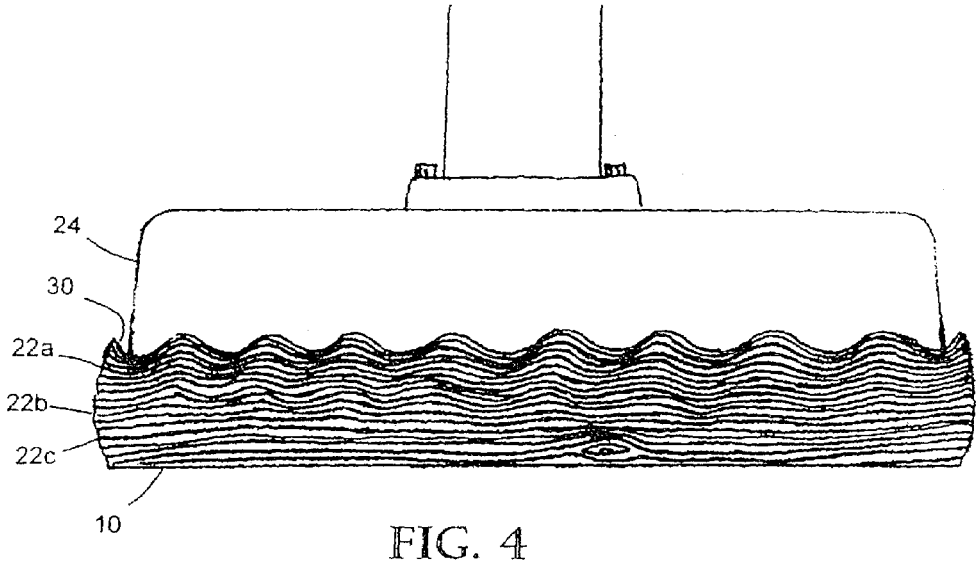
FIG. 4 is the view of FIG. 3 illustrating three-dimensional deformation of the wood by the embossing die during the embossing step.

When the embossing die 24 is pressed into the upper wood portion 10, the cell structure of wood portion 10 is deformed so that the upper surface 11 of wood portion 10 conforms to the pattern of the embossing die as illustrated at 30 in FIG. 4. As can be seen in FIG. 4, the embossing process reorients the cell structure a substantial distance into the wood from surface 30. The cell structure in the upper surface portion near the surface 30, as illustrated by line 22*a*, is significantly reoriented. Further down, as illustrated by line 22*b*, the cell structure is only slightly reoriented. Still further down, as illustrated by line 22*c*, the cell structure may be unaffected by the embossing process.

It is desirable that the cell structure be reoriented a substantial distance into the wood so that the pattern will be shown dramatically after the embossments are removed. To accomplish this, prior to embossing, the wood preferably undergoes a short-term "plasticization" process that increases the effectiveness of the embossing process by temporarily softening the lignin in the wood. Plasticization is not absolutely necessary to achieve a figured effect, but if not used, the final product will not be as stable and the figured effect will not penetrate as deeply into the wood.

Lignin is a chemical substance that comprises approximately twenty-five percent (25%) of the wood's substance; interspersed with cellulose it forms the cell wall. Lignin stiffens the cell wall and functions as a bonding agent between the cells. There are three principle methods to soften lignin, any of which can work in the present invention, and are as follows:

a) The first and most preferable method is by steaming the wood in a steam chamber at atmospheric pressure or higher. Steam penetrates into the wood surface within minutes and along with heat, softens the lignin a substantial distance into the wood, thereby allowing the cell structure to be reoriented a substantial distance into the wood. Upon embossing, the lignin is cooled by the unheated die and stiffens sufficiently to make the impression permanent;

b) The second method is by the use of a heated embossing die. This method softens the lignin as the die is being applied. This is a well-established method primarily used in industry because it is well-suited for mass production, but the cell reorientation may not extend as deep as it does with steaming;

c) The third method is to immerse the wood in anhydrous ammonia or subject the wood to pressurized ammonia gas. This procedure requires expensive and specialized equipment, as well as providing the obvious hazard of ammonia gas into the air.

Embossing raises a surface design by depressing the surrounding material. With the wood temporarily plasticized, embossing significantly reorients the cell structure of the wood surface, and more importantly, it reorients the cell structure below the surface to a varying degree. The subsurface effect of the embossing process diminishes with depth, typically to a depth below the valley surfaces about as great as the vertical distance between the level of the top surface of the peaks and the lower surface of the valleys. However, this depth could be 10%, 20%, 30%, 40% or 50% greater or smaller, depending on various factors.

The degree to which the cell structure can be reoriented depends on several factors: the type of the wood, the degree to which the wood has been softened, the die pattern depth, the thickness of the wood, and the amount of pressure and rate of speed with which the die is applied. Care should be taken not to exceed the plastic limit of the softened wood. To exceed this limit results in hairline cracking and tearing of the wood fibers in the areas of tension within the pattern.

There are two well-known embossing methods that can be used. The first method presses a flat die of the desired texture, design, or pattern into the plasticized wood surface. The second method rolls a textured or patterned roller over the wood surface. Each method must be applied with sufficient force to permanently deform the wood cell structure.

During the embossing process, the entire wood surface can be compressed to a varying degree. The result is a wood surface that is denser and hence harder, and more durable than the original wood surface. In one preferred embodiment of the present invention, the deformation of the cell structure can be to a depth as great as ⅛ inch. If the wood member is a sheet or piece of veneer having a total thickness dimension of about ¼ inch, the desired depth of the embossment (i.e., the vertical dimension from the peaks of the ridges to the floor of the valleys would be 1/16 inch and the underlying wood structure would be ⅛ inch, for a total of 3/16" thickness from the uppermost part of the peaks to the bottom surface of the wood member 10 (assuming there has been 1/16 inch total comparison). Obviously, these dimensions could be changed. The total thickness of the wood piece could be that of a wood panel, such as a nominal thickness of one inch, two inch, etc. Within the broader scope of the present invention, for the deformation of the wood/fiber cell to achieve a distinguishable effect, the depth dimension of the floors of the valleys relative to the peaks of the ridges should be at least about 0.005" (depending on the species of wood) to be noticeable. At a depth dimension of 0.01" of deformation, the effect is more noticeable, and this would increase by increments of one-hundredth of an inch to greater depth dimensions such as 0.02, 0.03, 0.04, 0.05, 0.06, 0.07, 0.08, 0,09, and 0.1". Obviously, this could be done also to greater depths, again with 0.01 increments (0.11, 0.12 inch, etc.) up to 0.15, 0.2 inch or greater.

After the wood has been embossed, it should be dried sufficiently before resurfacing so that the resurfacing process will cleanly remove material. This is especially important when steaming has been used as the plasticizing step.

Figure 5:
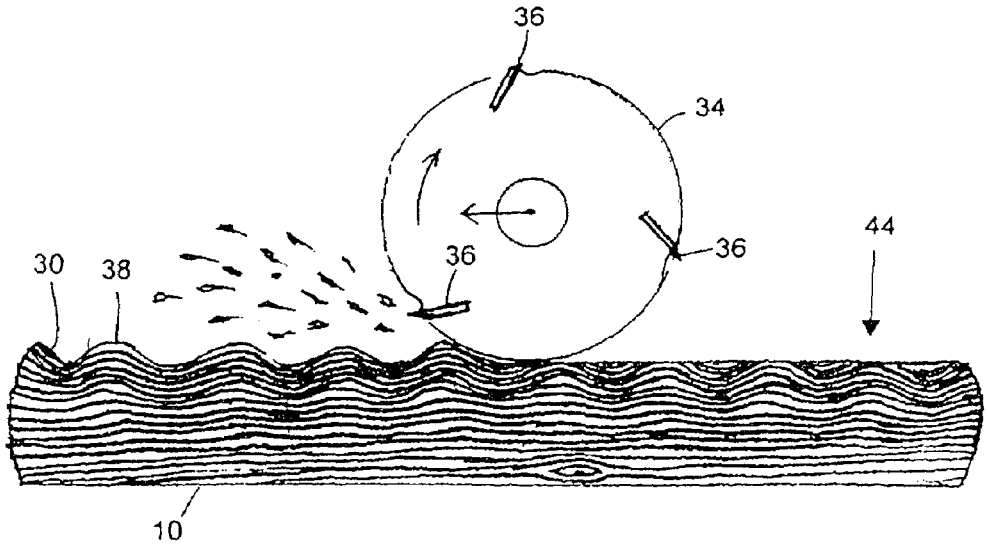
FIG. 5 illustrates removal of upper level embossments leaving a flat surface with variable-angled cell structure exposed, creating a three-dimensional effect.
Figure 6:
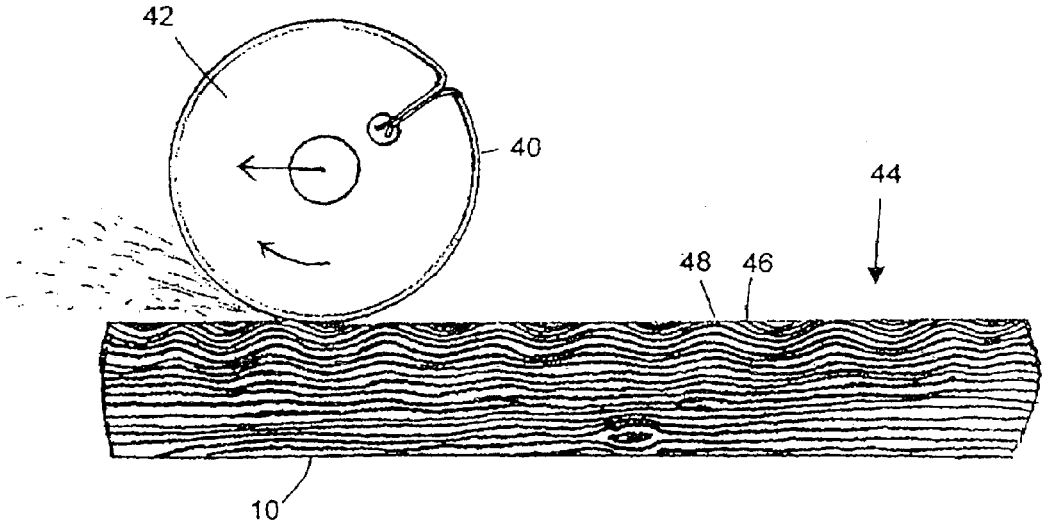
FIG. 6 illustrates smooth finishing of the piece of wood with variable-angled cell structure exposed on the surface.

Referring to FIGS. 5–6, after drying it is essential to remove the raised portions of the embossed surface. It is also important not to remove any more material than necessary to make the wood surface smooth. Since the effects of the embossing diminish with depth, removing more of the surface than necessary will decrease the intensity of the figure effect.

FIG. 5 illustrates one method of removing the raised portions of the embossments by a rotary power planer that has a plurality of blades 36 that cut the raised portions 38 of the embossments off. While such power planers are readily available and process wood quickly, with this method it is difficult to avoid tearing out chunks of the newly formed uneven grain in the wood surface 30.

FIG. 6 illustrates the preferred method of resurfacing is by sanding with progressively finer grits of coated abrasives 40, such as with drum sander 42 as illustrated.

On smaller scale work where the embossing is light and where very little material must be removed, hand-scraping works well to remove the raised portion of the embossments.

Embossing changes the angle of the cell structure that is visible at the resurfaced surface 44. Some of the cell structure 46 is angled upward, with nearby cell structure 48 substantially horizontal. Since the figured effect relies on light reflecting off the reflective surface of the variable angled wood cell structure, it is important to make each cell as distinct as possible. In other words, the smoother the surface is, the more vivid the figure will appear.

The resurfaced surface is then finished with a stain and/or clear durable finish. Since the clarity of the figured effect depends on light reflecting off the uneven or undulating wood grain structure, it is important to apply a finish that is generally transparent. It is also important for the finish to penetrate and to fill the newly exposed cells in the wood surface. When well-sanded and finished, the appearance of the figure can shimmer or change when the angle of the light source and/or the viewer's perspective changes.

Through this process has been described in terms of a flat material, it is possible to apply the process to non-flat surfaces such as curved surfaces or decorative molding. For such shapes, the embossing and resurfacing process follows the desired shape.

Figure 7:
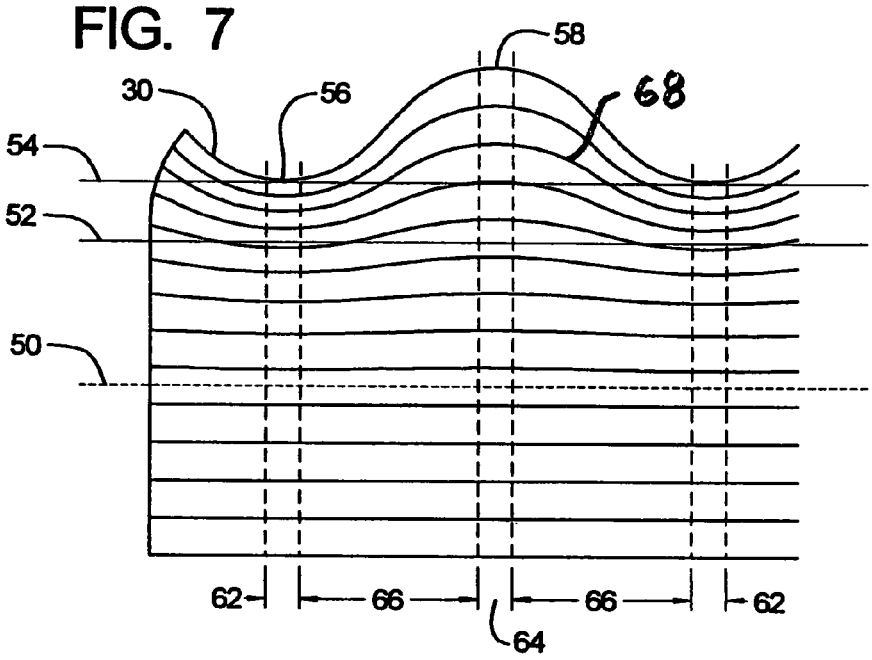
FIG. 7 is a cross-sectional view which has substantially the same representation as in FIG. 4, except drawn to a larger scale and being shown in more detail, and also illustrating the effects achieved by making the removal of the ridge portion of the embossed pattern.
Figure 8:
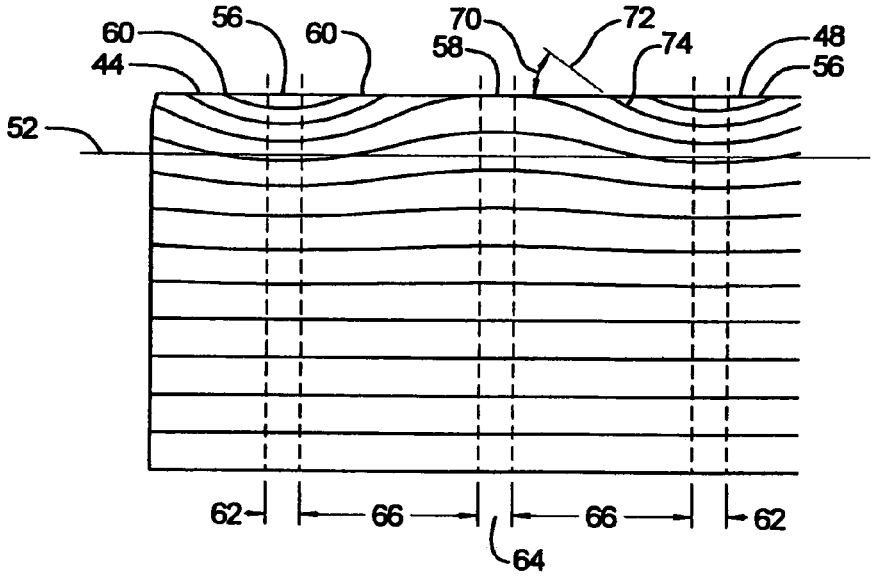
FIG. 8 is substantially the same as FIG. 7, but showing the effect of having a somewhat different plane orientation of the wood piece which is being treated.

Reference is now made to FIG. 7 and FIG. 8 to distinctly illustrate the effect this invention has on wood cell structure.

FIG. 7 illustrates a cross-sectional view of embossed wood member before resurfacing. Dotted line 50 shows the approximate extent of reoriented wood cells as a result of the embossing process. Line 52 shows the practical limit of affected wood cells.

The reoriented wood cells structure between line 54 and 52 is the area of preferred figured effect. The figured effect will be the most distinct within this area, with the effect diminishing the closer the resurfaced surface is to line 52.

The location of the lines 54 and 52 will vary depending on the extent to which the embossing process has effected the subsurface wood cell alignment.

FIG. 8 illustrates a cross-sectional view of wood section depicted in FIG. 7 except with the ridges, left by the embossing step, removed. Exposed in the resurfaced surface 44 are valley wood cells 56 that have been displaced downward from original wood surface 11 depicted in FIG. 3. Also exposed on the newly made surface 44, are ridge wood cells 58 that were originally subsurface. In-between the ridge cells 58 and valley cells 56 are angled transition wood cells 60. These cells are referred to as undulating wood cells and are the cells that contribute to the majority of the shimmering figured effect, and will have a three-dimensional appearance on the newly made two-dimensional surface.

Valley wood cells in the valley zone 62 above line 52, consist primarily of horizontal wood cells that will reflect light in a similar manner as the ridge wood cells in ridge zone 64 above line 52. There are the transition zones 66 between each adjacent pair of the zones 62 and 64, where there are the angled transitional wood cells 68 above line 52 that are undulating and reflect light in many directions and will shimmer as the light source changes. These are the cells in contrast with the valley cells 56 and ridge cells 58 that give the resurfaced surface 44 the desired figured appearance.

Let us now turn our attention back to FIG. 7 to review briefly the structure of the wood member 10 after the embossing step. The same zones 62, 64, and 66 that were described relative to FIG. 8 are also shown in FIG. 7. The ridge wood cells 56 in the ridge zones 64 can be considered to have a ridge wood cell structure with ridge wood cell structure portions at higher and lower levels, and in like manner the valley wood cells 58 in the valley zones 62 can be considered to have a valley wood cell structure with valley wood cell structure portions at higher and lower levels. It can be seen that the upper levels of the valley cell structure are displaced downwardly relative to corresponding ridge wood cell structure portions.

Likewise, the transition wood cells in the transition zones 66 can be considered to have a transition wood cell structure with transition wood cell structure portions being slanted and at higher and lower levels, and it can be seen that in that slanted configuration the transition cell structure portions slant downwardly from the related ridge wood cell structure portions to the related valley cell structure portions. Then, when the upper levels of the ridge wood cell structure portions are removed, the modified surface pattern is accomplished, as shown in FIG. 8. It will also be noted that the wood cell structure portions which are at a greater depth from the surface have the transition portions at lesser slants than those closer to the surface.

The embossment could be accomplished in various ways to accomplish various cell alignments in the transition zones. In FIG. 7, there is indicated at 70 an angle formed by an extension line 72 from a line 74 that for purposes of this discussion is representative of the alignment angle of the cell orientation of one of the more steeply slanted transition cell structure portions. Obviously, since certain portions of the cell orientation at the surface of the finished board are at different angles, depending on the depth cell portions, for purposes of this discussion we will consider those that are at the maximum angle.

For many applications, this slant angle 70 could be only a few degrees (i.e., namely greater than zero degrees, and anywhere from one degree, two degrees, three degrees, four degrees, five degrees, six degrees, seven degrees, eight degrees, nine degrees, or ten degrees). At the lower angled slant the effect created may be more "subtle" in that the three-dimensional perception may be somewhat less "striking". As the angle 70 increases up to five degrees, up to ten degrees, or various values in-between, the perception of greater depth would generally become stronger. Also, other factors may influence the effect produced by the finished surface, such as the structure of the wood, the angle or angles of the direction of the light may also be directed toward the surface being observed will have an effect.

In general, it would be expected that the maximum orientation of the angle 70 would be in the neighborhood of about one-half of a right angle, but even then it is possible for some applications where this could go to a greater angle, such as 50 degrees, 55 degrees, 65 degrees, or conceivably somewhat higher. For many of the applications now envisioned, the range from about five degrees or greater, possibly up to 15 degrees, with various degrees in one angle increments therebetween, would be a reasonable range. Nevertheless, for particular situations, and depending upon possibly around the character of the wood, the depth of the embossment, etc., these could be made greater in range between 15° degrees, 20° degrees, 30° degrees, 35° degrees, 40° degrees, and 45° degrees.

While all of the phenomenon which are involved in producing the visual effect produced by the present invention, may not be fully understood, it is believed that the following text would be at least a partial explanation of these. However, regardless of whether or not the following explanations are accurate or even in error in some respects, it has been found by actual experimentation that the results of obtaining the contrasting pattern in accordance with the practicing of the steps of the present invention are achieved.

When the upper woods surface portion is embossed, not only is the cell alignment modified, but also there would likely be a certain amount of compression of the wood cells. Further, when the plasticization step is accomplished, there is a softening of the lignin, and it is quite possible that there is a certain flow of the lignin from between the more compressed cells to possibly other adjacent portions of the wood. This also could have an effect on the appearance of the wood cells, the lightness or darkness of color, the reflectivity, and possibly other characteristics. Also, when some of the wood cells are at an alignment which is closer to perpendicular to the surface, it is quite possible that a number of these cells would be distorted laterally, in that they would collapse to one side or the other and be compressed in that manner. With the ridges removed and the wood surface finished, there is the contrasting pattern formed by the ridges and the valleys, but with the character of the contrasting regions being somewhat modified from those described above, relative to the more horizontal alignment of the wood cells.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention.

I claim:

1. A method of making a pattern in a wood surface, said method comprising:

a) providing a wood member which has a wood surface and wood cells formed in a wood cell structure which comprises a plurality of wood cell structure portions at higher and lower levels relative to said wood surface;

b) embossing said wood member at said wood surface to form a pattern of ridges and valleys at said wood surface, with the wood cell structure comprising ridge wood cell structure portions at higher and lower levels, valley wood cell structure portions at higher and lower levels, and also transition wood cell structure portions which are located between adjacent ridge and valley wood cell structure portions and which are slanted and are at higher and lower levels, with the valley wood cell structure portions being displaced downwardly relative to the ridge wood cell structure portions and with the transition wood cell structure portions slanting downwardly from adjacent ridge wood cell structure portions to adjacent valley wood cell structure portions;

c) removing at least upper portions of the ridge wood cell structure portions and upper portions of the transition wood cell structure portions to form a modified exposed surface comprising exposed wood surface portions which comprise lower level ridge portions of the ridge wood cell structure portions, and of higher level valley portions of the valley wood cell structure portions, and exposed wood surface portion of the transition wood cell structure portions;

whereby the modified exposed surface has a contrasting surface pattern with a three-dimensional visual effect.

2. The method as recited in claim 1, wherein prior to embossing said wood member, at least higher level wood cell structure portions of the wood member are plasticized to soften lignin therein.

3. The method as recited in claim 2, wherein said wood member is plasticized by subjecting the wood member to heat, or to the wood member by placing the wood member in a steam chamber, or by use of a chemical agent, or by either or both exposing the wood member to anhydrous ammonia or subjecting the wood member to pressurized ammonia gas, or combinations of these.

4. The method as recited in claim 1, wherein the embossing is accomplished by pressing a die against the wood surface.

5. The method as recited in claim 4, wherein the die that is pressed against the wood surface is a heated die.

6. The method as recited in claim 4, wherein said die is a flat die.

7. The method as recited in claim 4, wherein said die is a roller die.

8. The method as recited in claim 2, wherein said wood member is dried after embossing the wood member to create the valleys and ridges.

9. The method as recited in claim 1, wherein the removing of at least upper portions of the ridge grain alignment components is accomplished in a manner to form the modified exposed wood surface as a planar surface.

10. A decorative article of wood having a surface portion that has a three-dimensional portion that has a three-dimensional visual effect, with said article of wood having been formed from a wood member which has a wood surface and wood cells formed in a wood cell structure which comprises a plurality of wood cell structure portions at higher and lower levels relative to said wood surface and said wood member characterized as follows:

i) said wood member having previously been embossed at said wood surface in a manner to form a pattern of ridges and valleys at said wood surface at ridge zones and valley zones, respectively, with the wood cell structure comprising ridge wood cell structure portions at higher and lower levels, valley wood cell structure portions at higher and lower levels, and also transition wood cell structure portions which are at transition zones and are located between adjacent ridge and valley zones and which are slanted and are at higher and lower levels, with the valley wood cell structure portions being displaced downwardly relative to the ridge wood cell structure portions and with the transition wood cell structure portions slanting downwardly from adjacent ridge wood cell structure portions to adjacent valley wood cell structure portions;

ii) said wood member having had at least upper portions of the ridge wood cell structure portions and upper portions of the transition wood cell structure portions removed to form a modified exposed surface, said article of wood being characterized in that the surface portion thereof is arranged as follows:

a) surface portions at the ridge zones which comprise lower level ridge portions of the ridge wood cell structure portions;

b) surface portions at the valley zones which comprise higher level valley portions of the valley wood cell structure portions;

c) surface portions at the transition zones which comprise portions of the transition wood cell structure portions that are positioned at lower locations in the wood member after embossing and which have wood cell orientations which are aligned differently from wood cell orientations of the surface portions of the ridge zones and the valley zones, whereby light is reflected differently from the surface portions at the transition zones than from the surface portions of the ridge and valley zones.

11. The article of wood as recited in claim 10, wherein there is an angle of slant for said transition wood cell structure portions, and a maximum slant of the transition wood cell structure portions would be greater than zero degrees and not greater than about one-half of a right angle.

12. The article of wood as recited in claim 11, wherein said angle of slant is between about 3° degrees to about 35° degrees.

13. The article of wood as recited in claim 10, wherein said angle of slant is between about 5° degrees and 15° degrees.

14. A method of making a pattern in a wood surface, said method comprising:

a) providing a wood member which has a wood surface and wood cells formed in a wood cell structure which comprises a plurality of wood cell structure portions at higher and lower levels relative to said wood surface;

b) embossing said wood member at said wood surface to form a pattern of ridges and valleys at said wood surface, with the wood cell structure comprising ridge wood cell structure portions at higher and lower levels, valley wood cell structure portions at higher and lower levels, and also transition wood cell structure portions which are located between adjacent ridge and valley wood cell structure portions and which are slanted and are at higher and lower levels, with the valley wood cell structure portions being displaced downwardly relative to the ridge wood cell structure portions and with the transition wood cell structure portions slanting downwardly from adjacent ridge wood cell structure portions to adjacent valley wood cell structure portions;

c) removing at least upper portions of the ridge wood cell structure portions and upper portions of the transition wood cell structure portions to form a modified exposed surface comprising exposed wood surface portions which comprise lower level ridge portions of the ridge wood cell structure portions, and of higher level valley portions of the valley wood cell structure portions, and exposed wood surface portion of the transition wood cell structure portions, and with an angle of slant for said transition wood cell structure portions with a maximum slant of the transition wood cell structure portions being greater than zero degrees and not greater than about one-half of a right angle whereby the modified exposed surface has a contrasting surface pattern with a three-dimensional visual effect.

15. The method as recited in claim 14, wherein said angle of slant is between about 3° degrees to about 35° degrees.

16. The method as recited in claim 14, wherein said angle of slant is between about 5° degrees and 15° degrees.

* * * * *